US006209863B1

(12) United States Patent
Hummel et al.

(10) Patent No.: US 6,209,863 B1
(45) Date of Patent: Apr. 3, 2001

(54) STACK CHANGING DEVICE

(75) Inventors: Peter Hummel, Offenbach; Robert Ortner, Alzenau, both of (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 09/367,063

(22) PCT Filed: Feb. 3, 1998

(86) PCT No.: PCT/EP98/00565

§ 371 Date: Aug. 5, 1999

§ 102(e) Date: Aug. 5, 1999

(87) PCT Pub. No.: WO98/34863

PCT Pub. Date: Aug. 13, 1998

(30) Foreign Application Priority Data

Feb. 5, 1997 (DE) ..... 197 04 285

(51) Int. Cl.[7] ..... B65H 1/30
(52) U.S. Cl. ..... 271/158; 271/157; 414/790.1
(58) Field of Search ..... 414/788.4, 789.8, 414/790.1, 790.8; 271/157, 158, 159

(56) References Cited

U.S. PATENT DOCUMENTS 3,951,401 * 4/1976 Marass ..... 271/158
5,011,126 * 4/1991 Suzuki et al. ..... 271/159
5,096,372 * 3/1992 Maejima ..... 271/158
5,303,911 * 4/1994 Zahn et al. ..... 271/158
5,803,446 * 9/1998 Leuthold et al. ..... 271/159
6,000,691 * 12/1999 Chmelar ..... 271/158

FOREIGN PATENT DOCUMENTS 11 10 659 7/1961 (DE) .
39 31 710 4/1990 (DE) .
42 03 500 8/1993 (DE) .
595921 * 12/1947 (GB) ..... 271/159
403288733 * 12/1991 (JP) ..... 271/158

* cited by examiner

*Primary Examiner*—Robert P. Olszewski
*Assistant Examiner*—Steven B. McAllister
(74) *Attorney, Agent, or Firm*—Leydig, Voit & Mayer, Ltd

(57) ABSTRACT

A sheet stack changing device for a sheet processing machine having a main stack lifting mechanism and a remaining-stack carrying device. The remaining-stack carrying device has bars for temporarily holding a remaining stack, a drive mechanism for moving the bars forward into the stack and retracting the bars from the stack in a staggered relation to one another. The remaining-stack carrying device is raised by a lifting mechanism. A pulling mechanism connects the bars with a carrying rail slidably engaged on the remaining-stack carrying device so that the carrying rail slides forward with the bars and retracts independently from the bars.

11 Claims, 8 Drawing Sheets

STACK CHANGING DEVICE

FIELD OF THE INVENTION

The present invention relates to sheet-fed printing machines and, more particularly to an improved stack changing device for sheet feeders of sheet-fed printing machines.

BACKGROUND OF THE INVENTION

It is a known practice, in sheet feeders for sheet-fed printing presses or other sheet-processing machines, to provide arrangements for automated stack change. These may consist of rack-type structures, so-called remaining-stack carrying devices, which are provided with thrusting and lifting drives for the horizontal and vertical movement. Such so-called non-stop stack changers are suited, for example, during the printing of paper sheets, i.e. in machine running, to take over remainders of finished sheet stacks from, for example, a pallet with grooves, and to deposit them again on a new sheet stack subsequently installed in the sheet feeder. Known devices are distinguished by high constructive and assembly expenditure and require special constructions of the sheet feeders. Further, devices are used here, the remaining-stack carrying device of which have a rack engaging into the grooves of the pallet. This rack is to be removed in the joining of the remaining stack with the newly installed sheet stack as a whole between the two stack parts. This involves high drive forces and places very strong stresses on the sheets lying next to the section point. Furthermore, restraining means are to be provided which prevent a shifting of the stack parts, and, in the process, severely strain the stack edges. Furthermore, the operation of the sheet feeder itself is severely hindered or even rendered impossible. The sheet flow is difficult to control in the changing operation, so that waste sheets result again and again.

Devices have already been developed that partly avoid some of the disadvantages described.

Thus, from DE 3931710 C2 there is known a nonstop sheet feeder for sheet-fed rotary presses. It has a remaining-stack carrying device which is arranged underneath a conveyor table leading from the sheet feeder to the sheet-fed rotary press. The remaining-stack carrying device has a closed frame on which there are arranged nonstop rods which can be driven as piston rods of individual cylinders by means of a pressure medium and which are drivable into grooves of a pallet carrying a sheet stack. In the driven-in state, the nonstop rods lie on both sides of the frame and they are to be removed in succession out of the range of the sheet feeder. Nothing is said about the operating sequence. The control of the nonstop rods is very expensive and is not directly adaptable to the requirements of the stack changing operation.

A sheet feeder is known from DE 4 203 500 A1. It has, parallel to the sheet feeder, and allocated to this on the face side, an auxiliary stack-carrying device as an independent component. With this, over a common drive, individually drivable pointed bars are provided that are drivable in grooves of a pallet carrying a sheet stack. The drive system has individual chain drives that are coupleable onto the particular pointed bars. For the guidance and accessibility of the chain drives there are required special construction measures. The chain drives are unclamped constantly under a stand of a frame of their own and they completely block the space in from of the sheet feeder, so that the latter is not accessible. In the stack-changing process, the pointed bars in the joining of main stack and remaining stack are removed, first on the outside, then in the middle and last in the zone between the pointed bars already pulled from the stack zone, so that a gentle depositing of the remaining stack onto the sheet stack is produced. For this purpose the chain drives are coupled in an expensive manner onto the pointed bars such that the pointed bars can be driven only in common.

OBJECTS AND SUMMARY OF THE INVENTION

In view of the foregoing, an object of the present invention is to provide an improved stack changing device which overcomes the problems associated with prior art designs.

A more specific object of the present invention is to provide a stack changing device which allows for simple and continuous stack changing through the use of a drive that is optimally adapted to the desired stack changing conditions.

The present invention provides these and other advantages and overcomes the drawbacks of the prior art by providing a stack changing device with an improved pulling mechanism for moving the remaining-stack carrying bars.

It is advantageous that remaining-stack bars are provided which are movable independently from one another, and which are pulled, intermittently, out of the stack zone. The simple and compact drive proposed for this purpose makes possible the space-saving arrangement of the remaining-stack carrying device. A different height of the remaining-stack bars generates a smooth depositing movement of the remaining-stack onto the sheet stack. The continuous removal of the remaining-stack bars from the inside, outward, and in two stages, makes possible a gentle depositing of the remaining-stack onto the sheet stack. As the remaining-stack bars are formed with differing length, there results an improved work run-off. Further improvements are brought about by a staggering of the speed of the individual remaining-stack bars to one another.

These and other features and advantages of the invention will be more readily apparent upon reading the following description of preferred exemplary embodiments of the invention and upon reference to the drawings wherein:

While the invention will be described and disclosed in connection with certain preferred embodiments and procedures, it is not intended to limit the invention to those embodiments. Rather it is intended to cover all such alternative embodiments and modifications as fall within the spirit and scope of the invention.

DETAILED DESCRIPTION OF PREFERRED EMBODIMENTS

Figure 1:
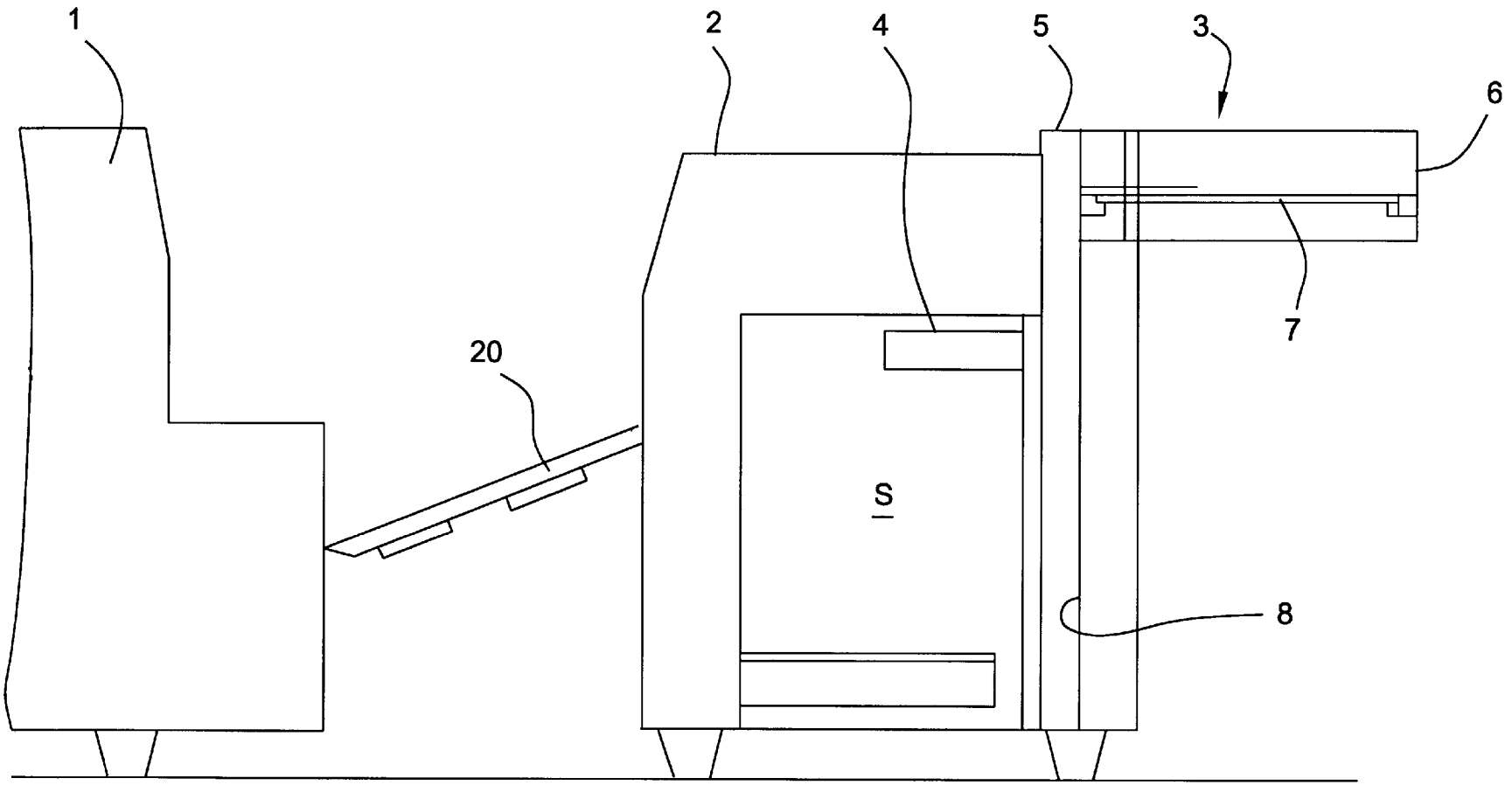
FIG. 1 is a side elevation view of an illustrative embodiment of a sheet feeder constructed in accordance with the present invention.

In FIG. 1 a sheet feeder 2 is represented connected with a sheet-processing machine, for example with a sheet-fed printing press 1. In the sheet feeder 2 there is installed a sheet stack S for processing. The sheet stack S can be lifted by means of a main-stack lifting mechanism, which is not represented in detail here, in the rhythm of the sheet processing. The sheets of the sheet stack S are singled on its upper side and fed to the sheet printing press 1 in a sheet stream. In the sheet feeder 2 there is provided for this a sheet singling arrangement 4 which is equipped with a considerable number of multiple operating elements for the format-dependent adjustments, and for adjustments of the supplying of suction or blast air. The operating elements serve for the attuning of the various functions of the sheet singling device 4 to the appropriate transport of the sheets from the sheet feeder 2 to the sheet-fed printing press 1. In the sheet feeder 2 there is arranged, further, a remaining-stack carrying device 3, which is allocated to the face side of sheet feeder 2 facing away from the sheet-fed printing press 1. The remaining-stack carrying device 3 is provided with a frame 6, in which remaining-stack bars 7 are borne longitudinally slidably. By means of the frame 6, the remaining-stack carrying device 3 is suspended on a remaining-stack lifting mechanism 5, which here is only indicated in its position. The remaining-stack lifting mechanism can lift a remaining-stack H from the remaining-stack carrying device in the rhythm of the sheet processing and is controllable synchronously with the main stack lifting mechanism.

Figure 2:
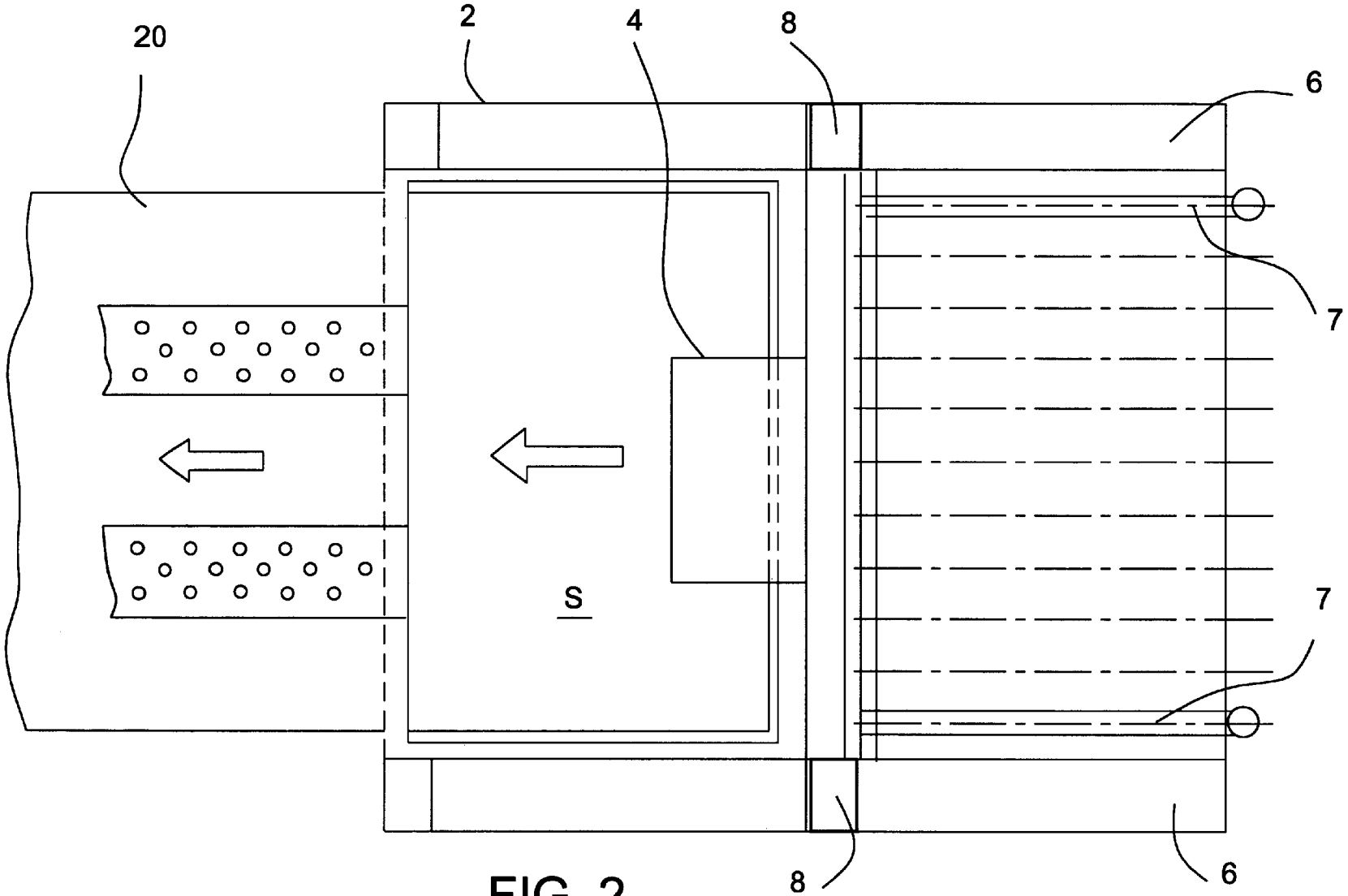
FIG. 2 is a plan view of a sheet feeder.

In FIG. 2, the sheet feeder 2 is shown in a top view. Upon the sheet feeder 2 there follows in the sheet running direction indicated by arrows, a conveyor table 20, over which the sheet stream generated by the singling is transported to the sheet processing machine, for example the printing press 1. Further, the position of the sheet singling device 4 allocated to the rear edge of the sheet stack S is shown. The orientation of the remaining-stack bars 7 is represented in its arrangement in relation to the sheet feeder 2, in which only the two outer remaining-stack bars 7 are represented, and the others are indicated with effect lines. The position shown is the waiting position outside of the operating zone of the sheet feeder 2. The remaining-stack bars 7 are guided within the remaining-stack carrying device 3, so that they occupy a horizontal position. The remaining-stack carrying device 3 with its frame 6 is guided in the sheet feeder 2 by means of the guide rails 8, and is vertically movable. The remaining-stack lifting mechanism 5 is located on the upper side of the guide rails 8, it engages from there on the frame 6 of the remaining-stack carrying device 3, and moves this latter up and down on the guide rails 8.

In FIG. 1 it is shown that the remaining-stack carrying device 3 is installed by means of the guide rails 8 directly into the sheet feeder 2 and can be lifted over the entire height of the sheet singling device 4. The remaining-stack lifting mechanism 5 is raisable and lowerable while supplying a sheet processing machine, for example the printing press 1, with sheets and the remaining-stack carrying device 3 is movable outside of the processing zone for proper stack change. By means of this arrangement of the sheet feeder 2, the latter is very well accessible from its face-side operating side.

Figure 3:
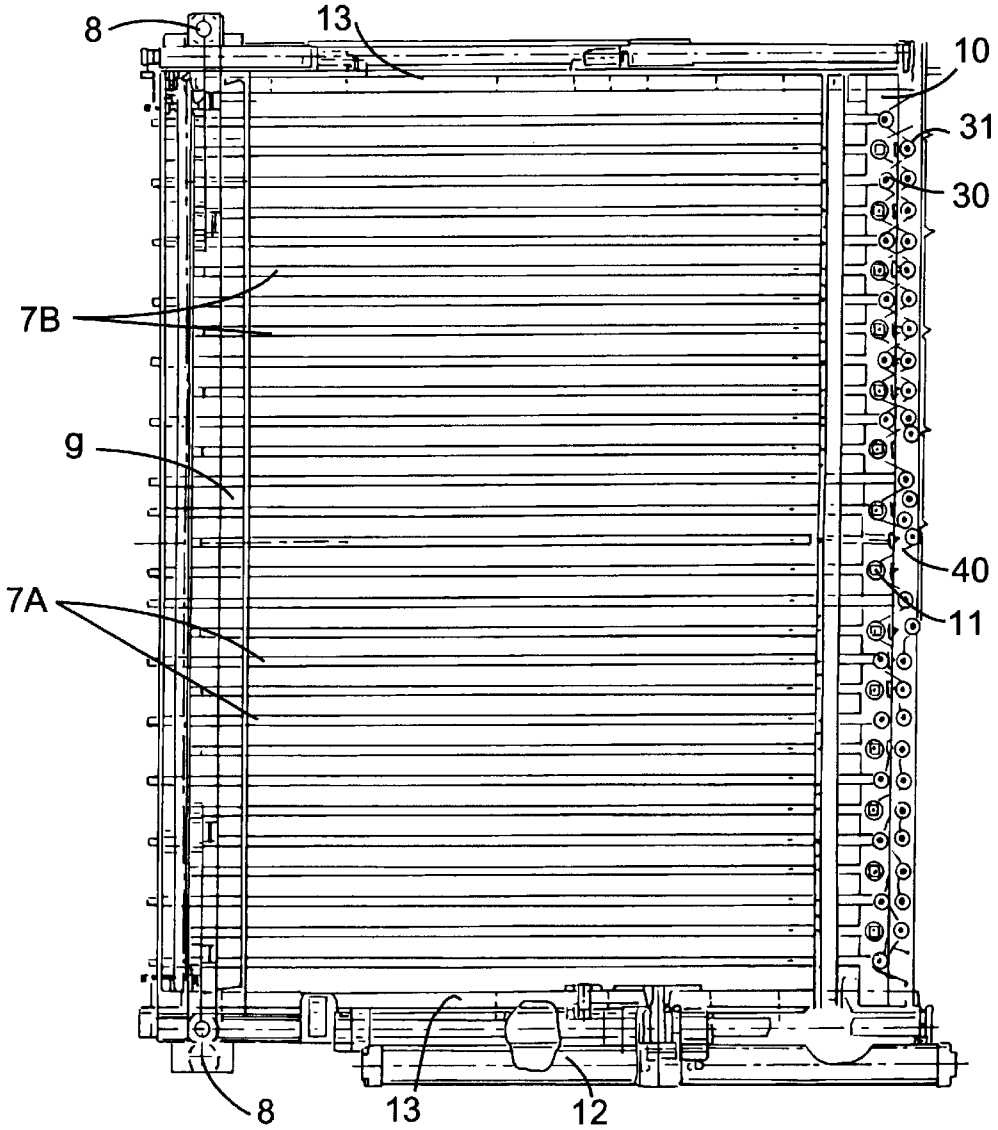
FIG. 3 is a plan view of a remaining-stack carrying device.
Figure 3:
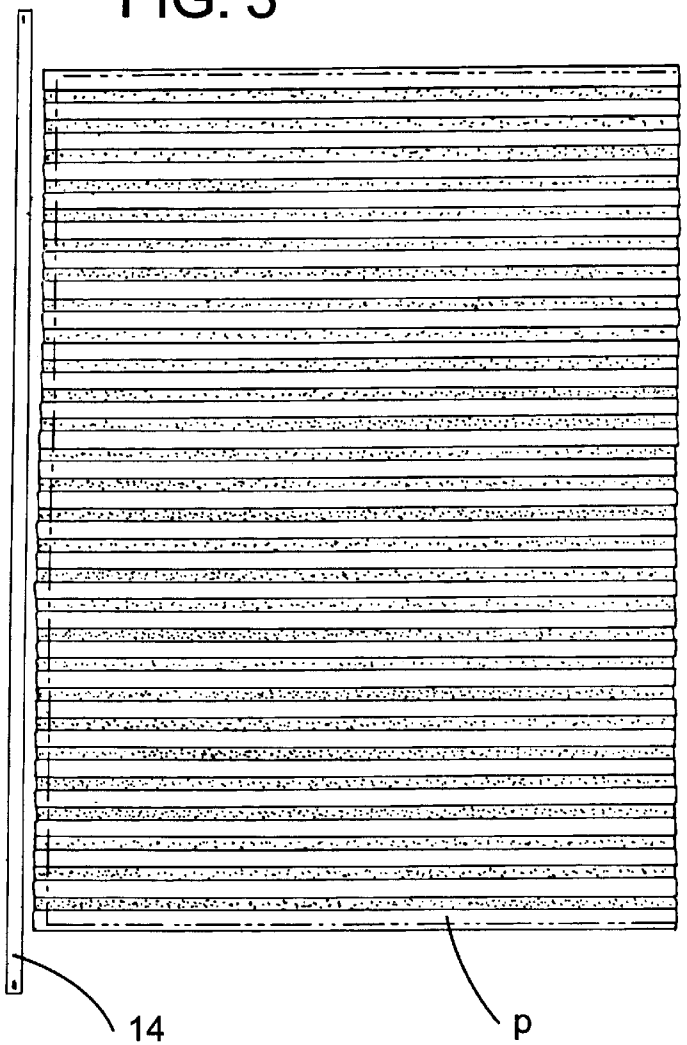

In FIG. 3 there is shown a complete representation of the remaining-stack carrying device 3. The frame 6 is vertically guided on the guide rails 8. In the frame 6 in a front carrying rail 9 there are guided the remaining-stack bars 7 in the form of carrying bars 7A and of spacing bars 7B. On a rear carrying rail 10 there is arranged a pull drive 11 for the singled pulling of the carrying bars 7A and spacing bars 7B. The position shown is the waiting position. Further, drives 12 are provided on both sides for the longitudinal shifting of the rear carrying rail 10 on guide rails 13 of the frame 6. The drives 12 determine the position of the rear carrying rail 10 on the rear end of, or within, the frame 6. The front carrying rail 9 is firmly joined with the frame 6. The carrying bars 7A and spacing bars 7B are of different height. The carrying bars 7A, for example, are about twice as high as the spacing bars 7B. By height there is meant the extension of the carrying bars 7A or spacing bars 7B perpendicular to the extended plane of the remaining-stack carrying device 3. The effect of this measure will again be thoroughly shown in the following representations.

The carrying bars 7A and spacing bars 7B can be of equal length. In a preferred form of execution the carrying bars 7A, however, are longer than the spacing bars 7B. In the taking-over of a remaining-stack H, the carrying bars 7A serve first of all for the load reception, and they are to be dimensioned correspondingly, in which context the load is to be deflected into a further carrying means (see FIG. 4).

Figure 4:
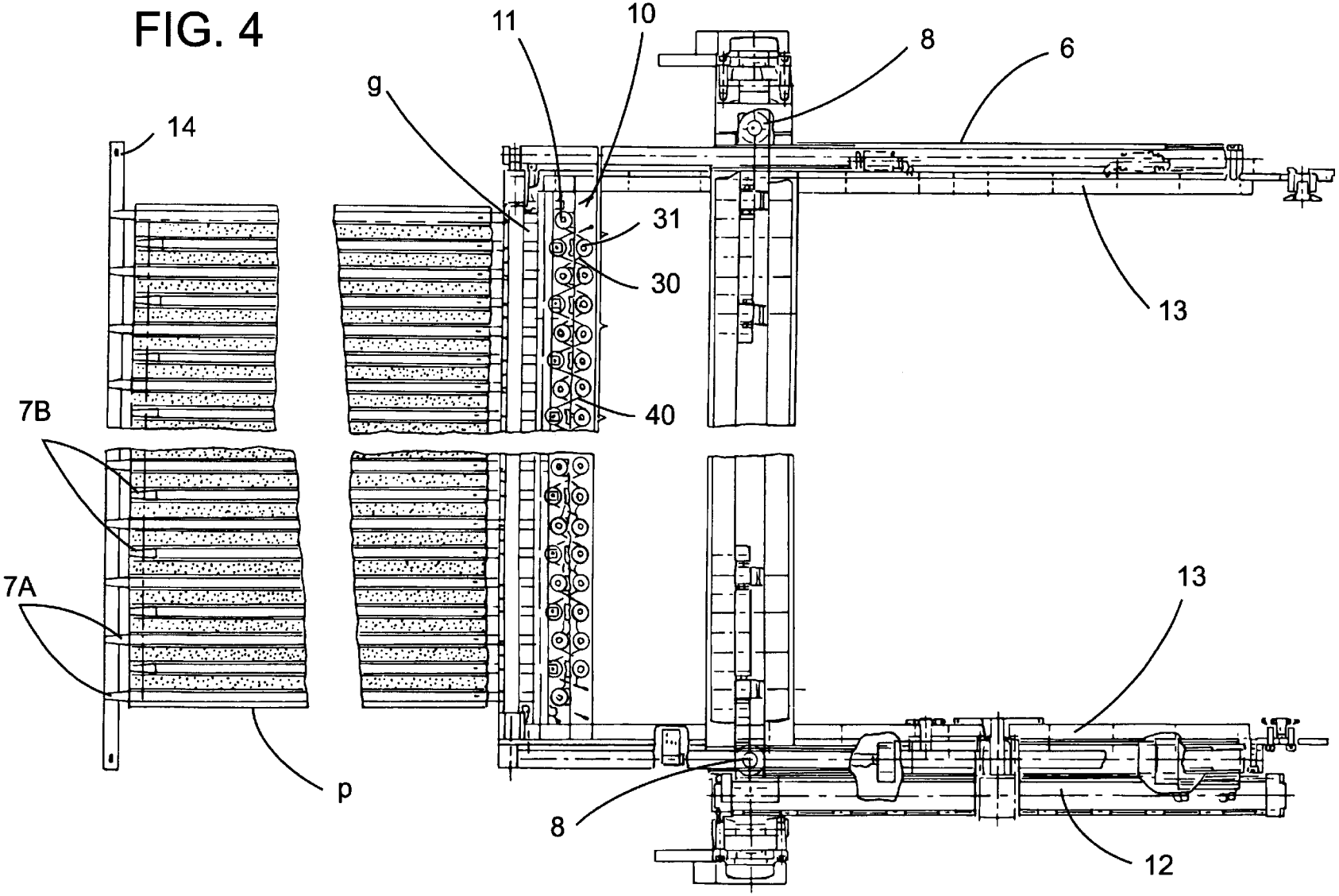
FIG. 4 is a plan view showing the remaining stack carrying device of FIG. 3 taking over of a remaining stack.

In FIG. 4 there is shown the remaining-stack carrying device 3 in operation. The carrying bars 7A as well as the spacing bars 7B are thrust forward by means of the drives 12, together with the rear carrying rails 10, with respect to the front carrying rail 9, and introduced into grooves of a pallet P carrying the sheet stack S. Front-carrying rail 9 and rear-carrying rail 10 with the pull drive 11 now lie parallel in front of the pallet P that carries a remainder of a sheet stack 5, the so-called remaining stack H. The pallet P and the remaining stack H are not touched there by the front carrying rail 9. The longer and higher carrying bars 7A lie on a remaining-stack lifting rail 14 on the front end (as seen in the sheet-running direction) in the sheet feeder 2. This remaining-stack lifting rail 14 is coupled with a lift drive and provided for support of the carrying bars 7A as well as for their lifting during the production. Both the remaining-stack lifting rail 14 and the remaining-stack lifting mechanism 5 are connected for this purpose with the auxiliary stack lifting device, or at least they are mechanically or controllably coupled with one another so that in the stack processing, but especially in the bringing-together of the remaining stack H with a new sheet stack S, they can be synchronously lifted.

From FIG. 4 it is further to be perceived that in the represented position of the remaining-stack carrying device 3 with the carrying bars 7A and the spacing bars 7B, the space within the frame 6 is free and the frame 6 is open to the rear. In this preferably monitored zone which here is shown shaded, operating procedures can be performed. For this handling it is likewise of importance that the carrying bars 7A and spacing bars 7B are slidable into the grooves of the pallet P early, i.e. long before the required changing process. The remaining-stack carrying device 3 can be raised in common with the sheet stack S until the stack change must actually occur. Then the remaining stack H only remains to be lifted from the pallet P. When the remaining-stack bars 7 are again pulled (i.e. the stack joining has occurred), the remaining-stack bars 7 are preferably immediately driven back into the new pallet P.

Figure 5:
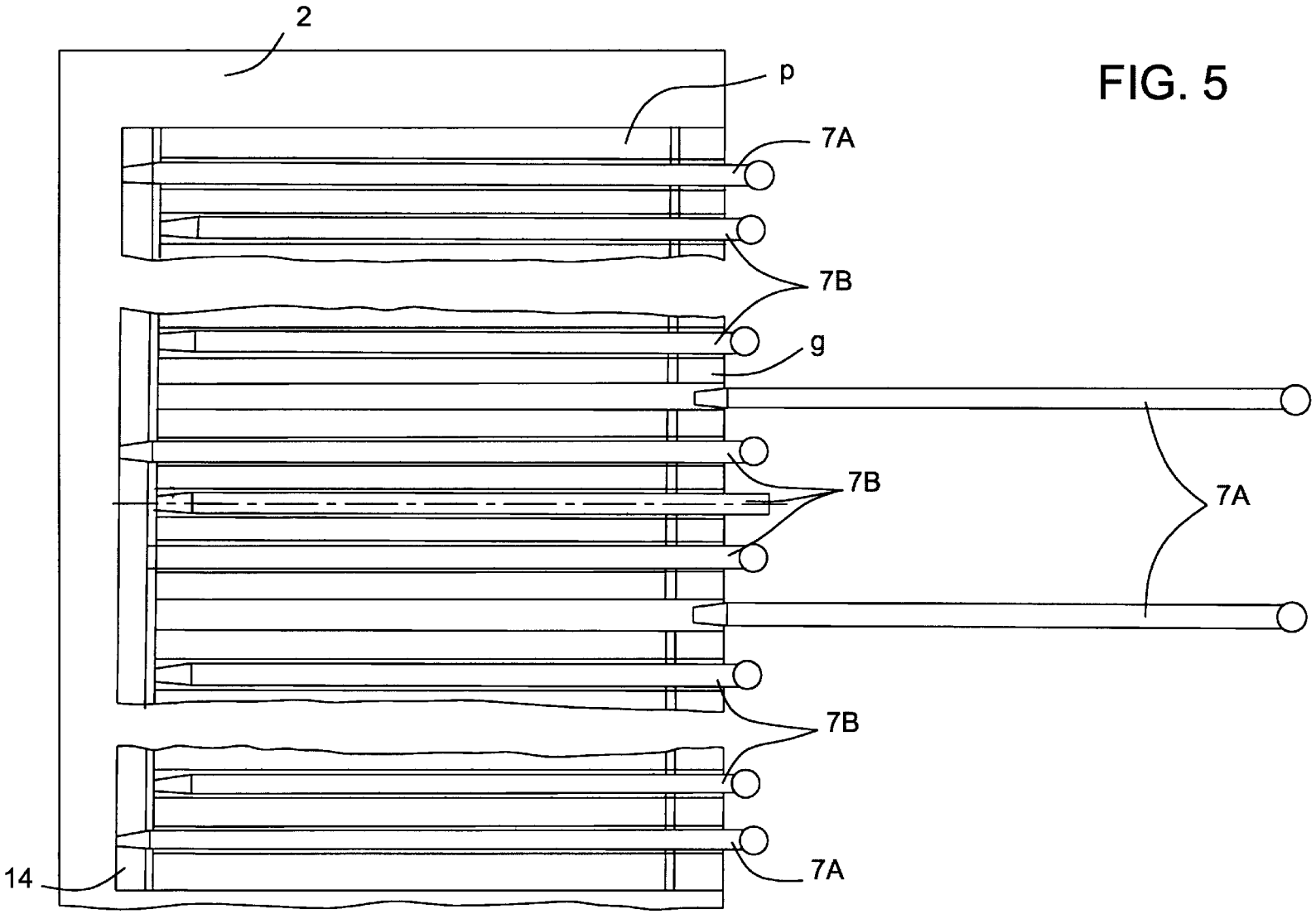
FIG. 5 is a plan view showing a stacking device during the stack changing.

In FIG. 5 the interrelation of the pulling movement to the arrangement is once again clarified within the sheet feeder 2. The carrying bars 7A and the spacing bars 7B lie alternately in grooves of a pallet P (in which context one must imagine oneself as lying on the webs between the grooves of the pallet P, perpendicular to the sheet stack S). The carrying bars 7A lie there on the remaining-stack lifting rail 14. The same holds in the illustrated cases for the inner spacing bars 7B which have only half the height of the carrying bars 7A. The pulling process of the carrying bars 7A begins with the carrying bars 7A lying next to the stack middle, which, as shown, are pulled as a pair. There the remaining-stack H in this zone comes to lie continuously on the thinner spacing bars 7B. The pulling of the thicker carrying bars 7A and then of thinner spacing bars 7B occurs smoothly and in close time sequence, but always separately from one another. For this a device for controlling the pull movement is provided.

The stack-changing, therefore, proceeds as follows:

I.—On reaching of a minimum height of the sheet stack S the stack-changing process is started.

II.—The carrying bars 7A and the spacing bars 7B are thrust in common from the frame 6 into the grooves of the pallet underneath the sheet stack S, the sheet stack S remaining free (open) on the rear side to the remaining-stack carrying device 3.

III.—The carrying bars 7A are undercut by the remaining-stack lifting rail and lifted until the remaining stack H is carried by the carrying bars 7A.

IV.—The pallet P is lowered and removed from the sheet feeder 2.

V.—The remaining stack H is further raised continuously by means of the auxiliary stack-lifting drive system for the singling of the sheets.

VI.—A new sheet stack S is installed in the sheet feeder 2 and raised by means of the main-stack lift.

VII.—On contacting of the upper side of the sheet stack S with the underside of the carrying bars 7A the pulling process of the carrying bars 7A is initiated.

VIII.—The carrying bars 7A are pulled out individually or in pairs from inside outward, from between the remaining stack H and the sheet stack S.

IX.—The remaining-stack H is deposited continuously onto the spacing bars 7B, from inside outward.

X.—The auxiliary stack-lifting rail becomes free, the remaining-stack carrying device 3 no longer takes on any load, the remaining spacing bars 7B still have only a control function for the stack unification.

XI.—The spacing bars 7B are continuously pulled out from inside outward, from between the remaining stack H and the sheet stack S.

XII.—The remaining stack H continuously comes to rest, from inside outward, onto the top side of the sheet stack S.

In a further form of execution, it can be provided not to use all of the remaining-stack carrying bars 7A. Thus, in the case of very thick sheet materials which as a result of their stability can sink only slowly into the interspace becoming greater between sheet-stack S and remaining-stack H, the spacing bars 7A can be omitted. Therewith the changing process is accelerated, since the time necessary for the pulling process of the spacing bars 7B is saved.

Figure 6:
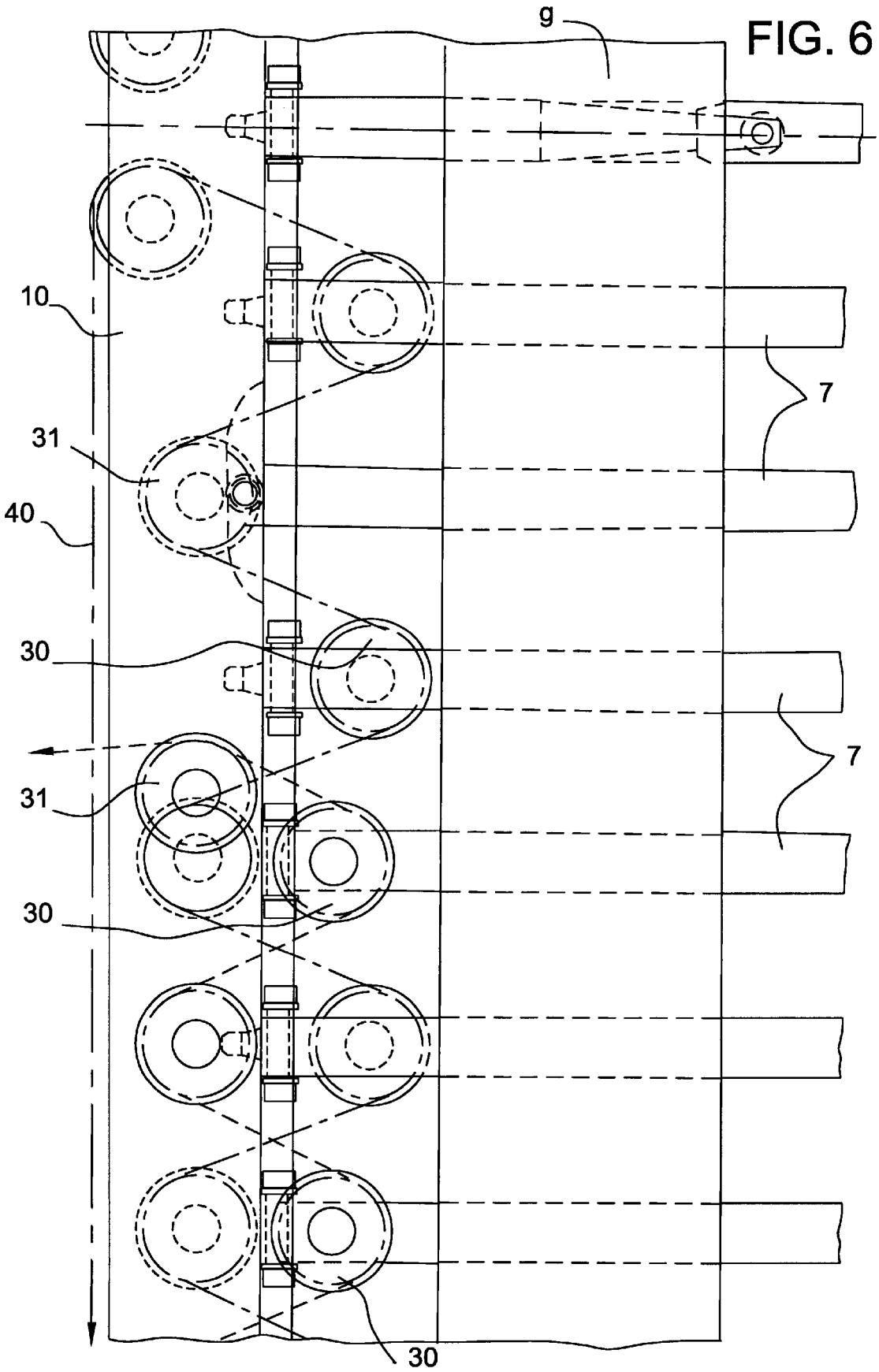
FIG. 6 is an enlarged partial plan view showing the drive for moving the remaining stack bars.
Figure 7:
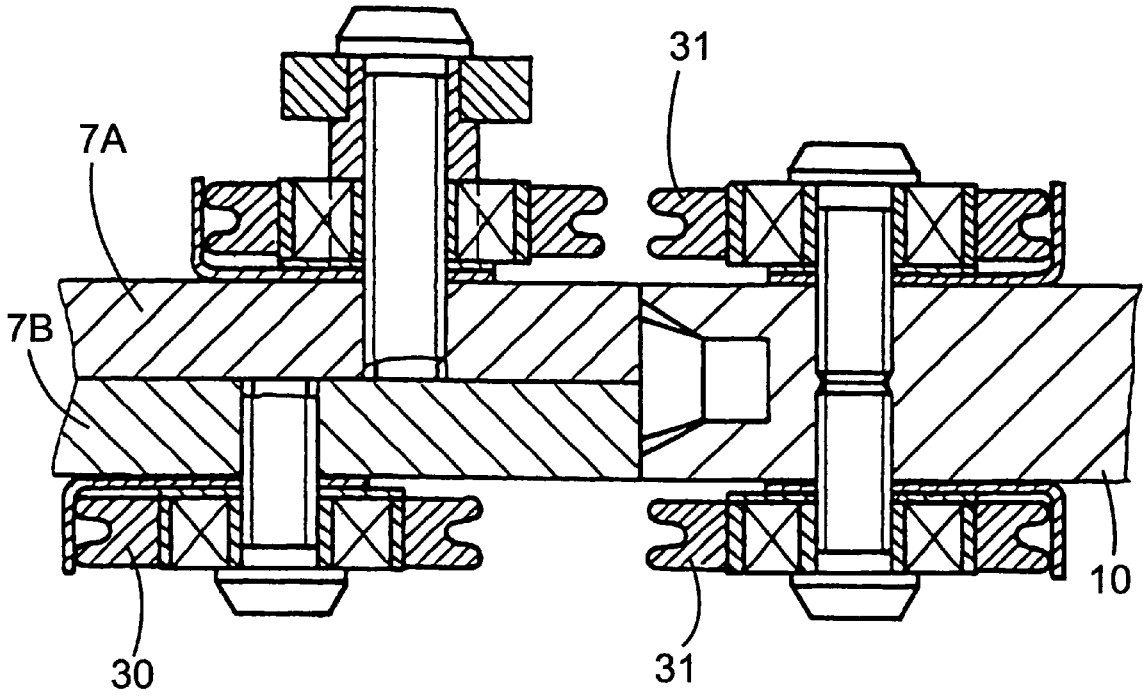
FIG. 7 is an enlarged partially cut away view of the cable deflection rollers.
Figure 8:
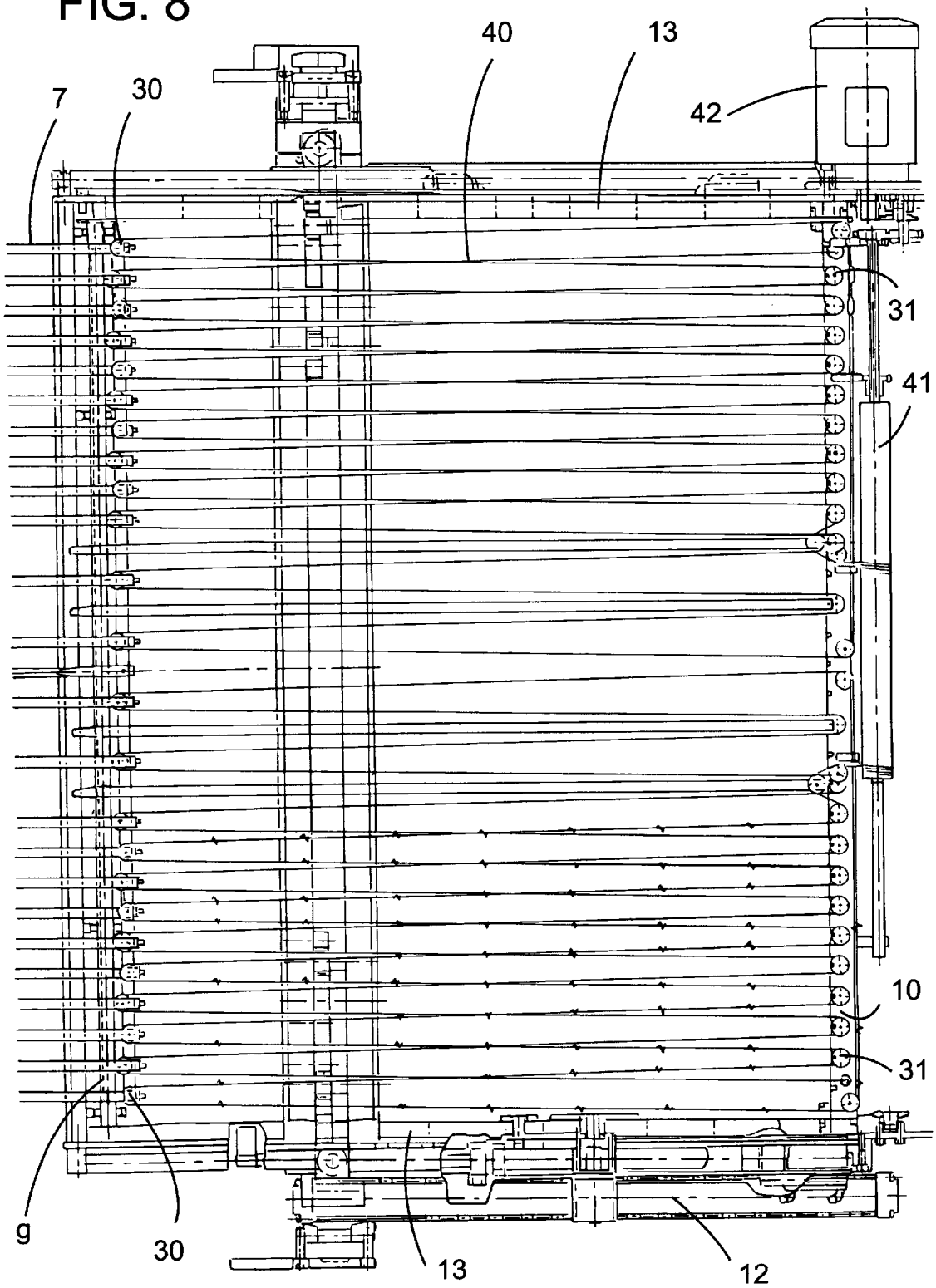
FIG. 8 is a plan view showing the cable pull operation.

As to the formation of the device for pulling the remaining-stack bars 7 it is already recognizable in part from FIGS. 3 and 4. Details and functioning are shown in greater detail in FIGS. 6, 7 and 8.

The remaining-stack bars 7 are represented in part as differently formed carrying bars 7A and spacing bars 7B, and they lie in the front carrying rail 9 and the rear carrying rail 10. The carrying bars 7A are longer and about twice as thick as the spacing bars 7B. All the remaining-stack bars 7 are provided at their end with a deflection roller 30 for the guidance of a cable 40. In correlation with this on the rear carrying rail 10 there are arranged further deflection rollers 31 for the cable 40. Cable 40 is so led by means of rollers 30 that the remaining stack bars are loaded toward the carrying rail 10. Cable 40 in this state is largely wound around a cable drum 41. The end of cable 40 is not firmly joined with the remaining-stack bars 7 but is movable both in common with these and also independently therefrom. The carrying rail 10 can be constructed to undercut the remaining-stack bars 7 or to limit their movement to the rear with impact. In order to move the remaining-stack bars 7, the rear carrying rail 10 is moved on guide rails 13 by means of a drive 12. Drive 12 can be constructed as a pressure-medium drive or as an electric motor drive. For the sliding-in of all the remaining stack bars 7 into the grooves of the pallet P, these are thrust forward in common by the drive 12, by means of the carrying rail 10 up to the front carrying rail 9 (FIG. 4).

For the pulling-out of the remaining-stack bars 7, the rear carrying rail 10 is first driven back independently from the remaining stack bars 7, by means of drive 12 going back into the starting position shown in FIG. 3. There, the remaining-stack bars 7, first at least the carrying bars 7A are clamped between the remaining stack-stack H and sheet stack S. They do not follow the movement of the rear-carrying rail 10. For this, the cable 40 is unrolled from a cable drum 41 arranged on the rear-carrying rail 10, which is releasable under control for this purpose. Cable 40 then runs over the cable rollers 30 and is stretched in zig-zag form between the remaining-stack bars 7 and the rear-carrying rail 10. After this, the remaining-stack bars 7 are pulled out of the stack zone by means of the cable 40. For this a cable drive 42 is provided which is likewise arranged on the rear carrying rail 10, the cable drive engages on the cable drum 41 and sets the latter into rotation. The rear carrying rail 10 is blocked by the drive 12 and takes up the tensile force from cable 40.

For the staggered pulling of the remaining-stack bars 7, on the rear carrying rail 10 there is provided, further, a locking mechanism which in dependence on the position of individual remaining-stack bars 7, either frees or blocks adjacent remaining-stack bars 7 for the pulling movement. For the control of the pulling movement, the remaining-stack bars 7 themselves can be used. Therewith it is made possible that by means of the one cable 40 the remaining-stack bars 7 can be pulled in a fixed pattern offset to one another.

A further development of the drive device provides that two cable drums 41 are arranged parallel to one another on the rear carrying rail 10. Then also two cables 40 are present, one cable 40 then being coupled with one half of the remaining-stack bars 7.

Likewise, both cable ends can be fastened to the cable drum 41. Then the cable 40 is guided outward from the carrying rail 10 by the deflection rollers 30 and is coupled in a cross bond from the outside of the carrying rail 10. In this case, through a doubled pulling movement on the cable drum 40 there is yielded a doubling of the pull path.

In particular, the cable guidance can be provided in such manner that first the carrying bars 7A, and only then the spacing bars 7B, are pulled. For this, the cable 40 is first conducted in the described pattern over the deflection rollers 30 of the carrying bars 7A and the corresponding deflection rollers 31 on the carrying rail 10. Then it is led back from the ends of the carrying rail 10 to the middle, and then again in the described pattern over the deflection rollers 30 of the spacing bars 7B and the corresponding deflection rollers 31 on the carrying rail 10. In this case, the deflection rollers are mounted on the carrying bars 7A or spacing bars 7B, and the assigned deflection rollers 31 are installed on the carrying rail 10 in a both-sided orientation. The cable guidance then occurs, on the one hand above the carrying rail 10 and, on the other hand, underneath this carrying rail 10.

The execution of the pull drive is not restricted to the use of a cable 40. For this purpose another tension means can be used, for example, also a chain or a belt.

What is claimed is:

1. Device for the changing of a sheet stack in a sheet feeder on a sheet processing machine with a stack lifting mechanism for the raising and lowering of a sheet stack, with a remaining-stack carrying device which contains remaining-stack bars for the temporary reception of a remaining stack and its transfer onto a newly fed-in sheet stack, in which the remaining-stack bars are provided with drive means for the generation of a lengthwise movement staggered with respect to one another in such manner that they are slidable into the stack zone and are removable in a staggered relation to one another from the stack zone, and with a remaining-stack lifting mechanism for the raising of the remaining-stack carrying device, characterized in that the remaining-stack bars (7), by means of a pulling drive, are connected with a carrying rail (10) slidably arranged in the remaining-stack carrying device (3), that the carrying rail (10) is arranged slidably forward in common with the remaining-stack bars (7), that the carrying rail (10) is retractable independently from the remaining-stack bars (7), and that the pulling drive is arranged on the carrying rail (10).

2. A device for changing a sheet stack in a sheet feeder of a sheet processing machine, the stack changing device comprising:

a stack lifting mechanism for raising and lowering of a sheet stack, a remaining-stack carrying device including remaining-stack bars for temporarily receiving a remaining stack and transferring said remaining stack onto a newly fed-in sheet stack, a drive mechanism for longitudinally moving the remaining-stack bars forward into a stack position and retracting the remaining-stack bars out of the stack position in staggered relation to one another, a remaining-stack lifting mechanism for raising the remaining-stack carrying device, and a pulling mechanism connecting the remaining-stack bars with a carrying rail, the carrying rail being slidably arranged on the remaining-stack carrying device such that the carrying rail can slide forward together with the remaining-stack bars and retract independently from the remaining-stack bars, wherein the pulling mechanism is arranged on the carrying rail.

3. The stack changing device according to claim 2 wherein the pulling mechanism includes at least one cable which is alternately stretched between deflection rollers arranged on the carrying rail and a respective deflection roller arranged on each of the remaining-stack bars.

4. The stack changing device according to claim 3 wherein the cable is fastened at a first end to a cable drum arranged on the carrying rail and at a second end to the carrying rail.

5. The stack changing device according to claim 2 wherein the pulling mechanism includes two cables which are fastened at their respective first ends to a cable drum arranged on the carrying rail and at their respective second ends to the carrying rail, and the cables are stretched from the middle of the carrying rail symmetrically outward between the remaining-stack carrying bars and the carrying rail.

6. The stack changing device according to claim 5, wherein a cable drum is provided for each of the cables.

7. The stack changing device according to claim 3 wherein the cable is fastened with both ends to a cable drum arranged on the carrying rail and is stretched from the middle of the carrying rail symmetrically outward between the remaining-stack carrying bars and the carrying rail.

8. The stack changing device according to claim 2 wherein the remaining-stack bars comprise carrying bars and spacing bars, with the carrying bars being relatively thicker than the spacing bars and wherein the carrying bars and the spacing bars are arranged in an alternating symmetrical arrangement over the width of the remaining-stack carrying device.

9. The stack changing device according to claim 8 wherein a cable is at first alternately stretched between deflection rollers on the carrying rail and respective deflection rollers arranged on each of the carrying bars, and the cable is further alternately stretched between deflection rollers on the carrying rail and respective deflection rollers arranged on each of the spacing bars.

10. The stack changing device according to claim 9 wherein for the carrying bars the cable is stretched on a first side of the carrying rail and for the spacing bars the cable is stretched on an opposing side of the carrying rail.

11. The stack changing device according to claim 10 wherein the pulling mechanism includes a cable drum having a drive, the drive having a controllable release and being operable at variable speeds.

* * * * *